US010915136B2

(12) United States Patent
O'Neill

(10) Patent No.: US 10,915,136 B2
(45) Date of Patent: Feb. 9, 2021

(54) DUAL MODE SENSING JOYSTICK ASSEMBLY

(71) Applicant: Sensata Technologies, Inc., Attleboro, MA (US)

(72) Inventor: Edmund C. O'Neill, Victoria, MN (US)

(73) Assignee: Sensata Technologies, Inc., Attleboro, MA (US)

( * ) Notice: Subject to any disclaimer, the term of this patent is extended or adjusted under 35 U.S.C. 154(b) by 0 days.

(21) Appl. No.: 16/405,277

(22) Filed: May 7, 2019

(65) Prior Publication Data

US 2020/0356131 A1 Nov. 12, 2020

(51) Int. Cl.
*G05G 9/047* (2006.01)
*G05G 5/03* (2008.04)

(52) U.S. Cl.
CPC ..... *G05G 9/047* (2013.01); *G05G 5/03* (2013.01); *G05G 2009/0474* (2013.01); *G05G 2009/04766* (2013.01)

(58) Field of Classification Search
CPC .. G05G 9/047; G05G 5/05; G05G 2009/0474; G06F 3/0338; G06F 2203/015
USPC ..... 345/161
See application file for complete search history.

(56) References Cited

U.S. PATENT DOCUMENTS 2,062,108 A 11/1936 Rickerson
3,676,818 A 7/1972 Oliver
4,535,647 A 8/1985 Gault
4,723,458 A * 2/1988 Blok ..... G05G 5/05 137/636
4,943,182 A 7/1990 Hoblingre
(Continued)

FOREIGN PATENT DOCUMENTS

CN 201677915 12/2010
CN 104085442 10/2014
(Continued)

OTHER PUBLICATIONS

Sensors Magazine—Angular Position Sensing with 2-Axis Hall ICs; https://www.sensorsmag.com/components/angular-position-sensing-2-axis-hall-ics; Jan. 1, 2019, 9 pages.
(Continued)

*Primary Examiner* — Koosha Sharifi-Tafreshi
(74) *Attorney, Agent, or Firm* — Mark. H. Whittenberger; Holland & Knight LLP

(57) ABSTRACT

A joystick assembly includes a joystick and pre-load centering springs coupled to the joystick for biasing the joystick to a neutral position. The joystick has a central free-play zone, a transitional zone surrounding the central free-play zone in which the pre-load centering springs begin to act upon the joystick, and a load zone surrounding the transitional zone in which the pre-load centering springs exert a relatively flat spring rate upon the joystick. An angular position sensor system generates a first signal indicative of a travel angle of the joystick. A force sensor system generates a second signal indicative of a force applied to the joystick. A controller receives the first and second signals and sets start/stop points for control by the joystick approximately synchronously with the joystick moving from the transitional zone to the load zone based upon the second signal.

15 Claims, 8 Drawing Sheets

(56) References Cited

U.S. PATENT DOCUMENTS

| | | | | |
|---|---|---|---|---|
| 5,083,883 | A | 1/1992 | Ueda et al. | |
| 5,623,093 | A | 4/1997 | Schenkel et al. | |
| 5,884,724 | A | 3/1999 | Bohner et al. | |
| 6,097,286 | A | 8/2000 | Discenzo | |
| 6,116,370 | A | 9/2000 | Puigbo | |
| 6,219,604 | B1 | 4/2001 | Dilger et al. | |
| 6,481,526 | B1 | 11/2002 | Millsap et al. | |
| 6,578,444 | B1 | 6/2003 | Wendelin | |
| 6,598,695 | B1 | 7/2003 | Menjak et al. | |
| 6,688,645 | B2 | 2/2004 | Andonian et al. | |
| 6,691,589 | B2 | 2/2004 | Gillman et al. | |
| 6,728,615 | B1 | 4/2004 | Yao et al. | |
| 6,820,713 | B2 | 11/2004 | Menjak et al. | |
| 6,896,089 | B2 | 5/2005 | Mills et al. | |
| 6,926,112 | B2 | 8/2005 | Husain et al. | |
| 6,987,508 | B2 | 1/2006 | Numata et al. | |
| 7,174,987 | B2 | 2/2007 | Husain | |
| 7,232,006 | B2 | 6/2007 | Dominke et al. | |
| 7,325,644 | B2 | 2/2008 | Sakai | |
| 7,886,632 | B2 | 2/2011 | Stoffers et al. | |
| 7,946,195 | B2 | 5/2011 | Ito et al. | |
| 8,752,664 | B2 | 6/2014 | Rombold | |
| 9,004,218 | B2 | 4/2015 | Gulati et al. | |
| 9,152,165 | B2 * | 10/2015 | Kreitmair-Steck | B64C 27/56 |
| 9,475,519 | B2 | 10/2016 | Nagl et al. | |
| 9,662,755 | B2 | 5/2017 | Yamanaka | |
| 9,919,732 | B2 | 3/2018 | Levesque et al. | |
| 2003/0117372 | A1 | 6/2003 | Hayasaka | |
| 2004/0064229 | A1 | 4/2004 | Stout et al. | |
| 2004/0167642 | A1 | 8/2004 | Matsumoto et al. | |
| 2006/0007144 | A1 | 1/2006 | Mathiasen et al. | |
| 2009/0168594 | A1 | 7/2009 | Stephenson et al. | |
| 2010/0302017 | A1 * | 12/2010 | Guglielmo | B66F 11/04 340/407.2 |
| 2013/0229272 | A1 | 9/2013 | Elliott | |
| 2016/0085257 | A1 | 3/2016 | Moehling et al. | |
| 2017/0320515 | A1 | 11/2017 | Levesque et al. | |

FOREIGN PATENT DOCUMENTS

| | | | |
|---|---|---|---|
| CN | 203876812 | | 10/2014 |
| CN | 204020971 | | 12/2014 |
| CN | 106275058 | | 1/2017 |
| DE | 19834868 | | 2/2000 |
| DE | 10046167 | | 5/2001 |
| DE | 10305132 | | 11/2004 |
| DE | 102013014133 | | 10/2014 |
| DE | 102013014137 | | 10/2014 |
| DE | 102013014138 | | 12/2014 |
| DE | 102014001747 | | 8/2015 |
| EP | 09366529 | A1 | 8/1999 |
| EP | 2840012 | | 2/2015 |
| FR | 2733610 | | 10/1996 |
| JP | 2004330840 | | 11/2004 |
| JP | 2006282133 | | 10/2006 |
| JP | 2010173592 | | 8/2010 |
| JP | 2012006487 | | 1/2012 |
| JP | 2012091677 | | 5/2012 |
| KR | 1020090007992 | | 1/2009 |
| WO | 2017182502 | | 10/2017 |

OTHER PUBLICATIONS

Susan Hill et al.; Army Research Laboratory; The Use of a Steering Shaping Function to Improve Human Performance in By-Wire Vehicles; Mar. 2008, 34 pages.

Great Britain Search Report in related GB Application No. GB2005161.1 dated Oct. 7, 2020, 1 page.

* cited by examiner

DUAL MODE SENSING JOYSTICK ASSEMBLY

BACKGROUND

1. Field of the Technology

The subject disclosure relates to joysticks, and more particularly to improved joysticks for work vehicles and other applications that require enhanced response and performance.

2. Background of the Related Art

In recent years, control of construction and agriculture vehicles has transitioned to electro-hydraulic control. Some resistance exists because of controllability deficiencies. In joystick applications, operator feedback and effective control are particularly desirable.

Electro-hydraulic joysticks typically use magnetic sensors to determine motion in two axis. Springs cause physical auto-centering when force is not applied to the joystick. A wide neutral band exists about the spring centered position that does not have the associated tactile feel such as in pilot hydraulic control systems. As a result, it can be difficult for operators to control fine movements and/or work in tight spaces. However, the wide neutral band is required to accommodate mechanical free-play at the spring centered position of the joystick.

U.S. Pat. No. 9,004,218 issued to Gulati et al. on Apr. 14, 2015 (Gulati et al.) attempts to improve joystick feel. Gulati et al. utilize additional spring force to vary the force required to move the joystick from neutral position to full stroke position. U.S. Pat. No. 3,676,818 issued to Oliver on Jul. 11, 1972 discloses a control stick transducer.

In FIG. 1, a graph 100 of torque versus travel angle is shown for a typical prior art electro-hydraulic joystick. The torque curve 102 has three distinct zones. A free-play zone F is centered about 0° of travel angle where the pre-load centering springs have returned the joystick to center and little, if any, force is required to move the joystick. Outward movement of the joystick of greater than about +/−0.3° to about +/−0.75° causes the pre-load centering springs to start to act on the joystick creating transitional zones T.

Movement beyond about +/−0.75° is in a loaded zone L where the pre-load centering springs are fully acting on the joystick and the relatively flat spring rate of the springs creates a fairly consistent feel for the operator. For clarity, only the loaded zone L on the left of FIG. 1 is designated. As can be seen, the points 102*a*, 102*b* where the start of the metering begins is at approximately greater than 2° away from center. Thus, a wide neutral band W of over 4° is created to compensate for error factors such as temperature related drift 104 of the position sensor, signal noise 106, calibration error 108 and the like. The wide neutral band W does create some feedback problems such as the lost ability to "feel" the start/stop points 102*a*, 102*b* because the start/stop points 102*a*, 102*b* are undesirably not well synchronized with the loaded zone L.

Another problem of electronic vehicle controls is the requirement of functional safety requirements. In response, many systems implement redundant sensing designs. However, if the redundant sensor is the same technology as the primary sensor, common cause failures can result. For example, parasitic magnetic fields could prevent proper operation of both sensor systems.

SUMMARY

In view of the above, a need exists for improved start/stop action of the joystick in a robust design that has redundancy for safety and robustness to avoid common cause failures. The subject technology provides improved control particularly well for fine movements. Safety is enhanced by using different technology for position sensing (e.g., magnetic technology) and joystick force. A large number of technologies available for sensing joystick force such as, without limitation, various strain gauge technologies (e.g., thin film, Microfused strain gauge, MEMS, peizoresistive and the like). Additional joystick force sensing technology includes capacitive force sensors, LVDT based force sensors, inductive sensors applied directly to a compression spring measuring the deflection of the spring through the change in inductance, and a Wheatstone bridge in tension. By using varying technology, common cause failures are avoided. Further, the position sensors and the force sensors provide plausibility checks on each other. Still further, the combination of sensors provides for improved safety and reduced production cost by simplifying and improving the initial calibration of the joystick assembly. The subject technology is applicable to any joystick application but particularly applicable where sensitive control is required such as in F-15 fighter jets, backhoes and the like. It is further applicable to applications such as wheelchairs and gaming technology as well. The subject technology may be combined with other haptic mechanisms as well.

The present disclosure is also directed to a joystick assembly including a joystick mounted for rotational movement about a circular area. At least one pre-load centering spring couples to the joystick for biasing the joystick to a neutral position. The joystick has a central free-play zone about a neutral position, a transitional zone surrounding the central free-play zone in which the at least one pre-load centering spring begins to act upon the joystick, and a load zone surrounding the transitional zone in which the at least one pre-load centering spring exerts a relatively flat spring rate upon the joystick. An angular position sensor system generates a first signal indicative of a travel angle of the joystick. A force sensor system generates a second signal indicative of a force applied to the joystick. A controller receives the first and second signals. The controller is operative to set start/stop points for control by the joystick approximately synchronously with the joystick moving from the transitional zone to the load zone based upon the second signal.

Preferably, the start/stop points are set in the transitional zone at least 10% of the transitional zone from the load zone. The control may be fluid metering in an electro-hydraulic vehicle. The controller may also compare the first and second signals so that an error signal is generated when the first and second signals are significantly different. The difference may be compared to an error threshold. The threshold may be less than 1%, 5%, 10% and the like depending upon the desired parameters for the application. In one embodiment, the controller calculates a slope of a force curve based on the second signal to determine the zones during an auto-calibration routine.

Another embodiment of the present disclosure is directed to a dual mode sensing joystick assembly for an electro-hydraulic vehicle comprising a joystick and pre-loaded centering springs coupled to the joystick for biasing the joystick to a neutral position. Angular position sensors are provided for generating a first signal indicative of travel angle of the joystick. Force sensors are provided for generating a second signal indicative of a force applied to the joystick. A controller is provided for receiving and processing the first and second signals. The controller is operative to determine initial deflection of the pre-loaded centering springs based upon the second signal so that fluid metering in the electro-hydraulic vehicle is controlled by the first signal synchronized with the initial deflection.

The subject technology is also directed to a joystick assembly having a joystick and means for biasing the joystick to a neutral position. The joystick assembly also has angular position sensor means for generating a first signal indicative of travel angle of the joystick and force sensor means for generating a second signal indicative of a force applied to the joystick. A controller means processes the first and second signals, wherein the controller means is operative to determine initial deflection of the pre-load centering springs based upon the second signal so that fluid metering in the electro-hydraulic vehicle is controlled by the first signal starting at approximately the initial deflection. Preferably, the means for biasing the joystick is a pre-load spring mechanism, the angular position sensor means is a magnetic sensor system, the force sensor means is a resistive system on a flexible platform arrangement or a pressure sensor coupled to the pre-load centering springs, and the controller means is electronics on a printed circuit board coupled to the sensors.

Still another embodiment of the subject technology is directed to a joystick assembly including a joystick, angular position sensors for generating a first signal indicative of travel angle of the joystick, and force sensors for generating a second signal indicative of a force applied to the joystick. A controller receives the first and second signals, wherein the controller is operative to evaluate a torque curve for the force applied to the joystick to determine start points based on the second signal so that metering based on the first signal is optimized and synchronized with a haptic feel of the joystick. The controller may be further operative to perform a calibration data routine to determine the torque curve. The controller may also be further operative to use a slope of the torque curve to determine a transition zone, wherein the transition zone surrounds a centrally located free-play zone, a loaded zone surrounds the transition zone, and the start point is approximately at a junction of the transition zone and the loaded zone. The centrally located free-play zone, the transition zone and the loaded zone can be determined by analysis of a local slope of the torque curve. The start point may be approximately 10% of the transition zone into the load zone. The controller can also be further operative to apply a plausibility algorithm based upon comparing the first and second signal to stored position and force sensor value pairs and/or calculate a derivative of the torque curve. The joystick assembly may also include a switch in communication with the controller so that metering control based upon the first signal can be selected. Preferably, the controller can calculate an end-of-travel position based upon the first signal during a calibration routine.

It should be appreciated that the subject technology can be implemented and utilized in numerous ways, including without limitation as a process, an apparatus, a system, a device, a method for applications now known and later developed such as a computer readable medium and a hardware device specifically designed to accomplish the features and functions of the subject technology. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the following drawings.

DETAILED DESCRIPTION OF PREFERRED EMBODIMENTS

Figure 1:
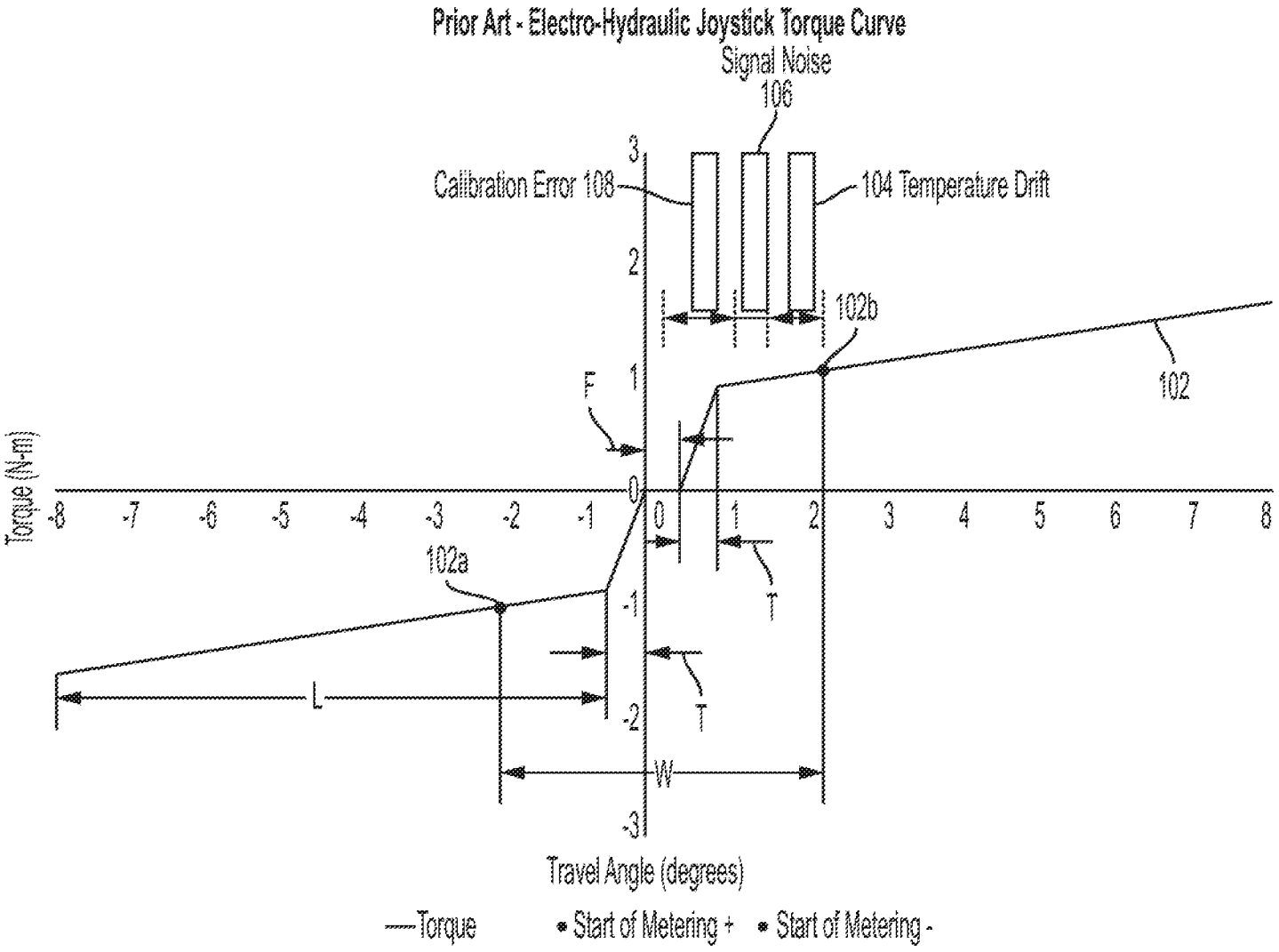
FIG. 1 is a graph of torque versus travel angle for a typical prior art electro-hydraulic joystick.

The subject technology overcomes many of the prior art problems associated with electro-hydraulic joysticks. The advantages, and other features of the technology disclosed herein, will become more readily apparent to those having ordinary skill in the art from the following detailed description of certain preferred embodiments taken in conjunction with the drawings which set forth representative embodiments of the present invention and wherein like reference numerals identify similar structural elements. It is understood that references to the figures such as left and right are with respect to the figures and not meant in a limiting sense.

Figure 2A:
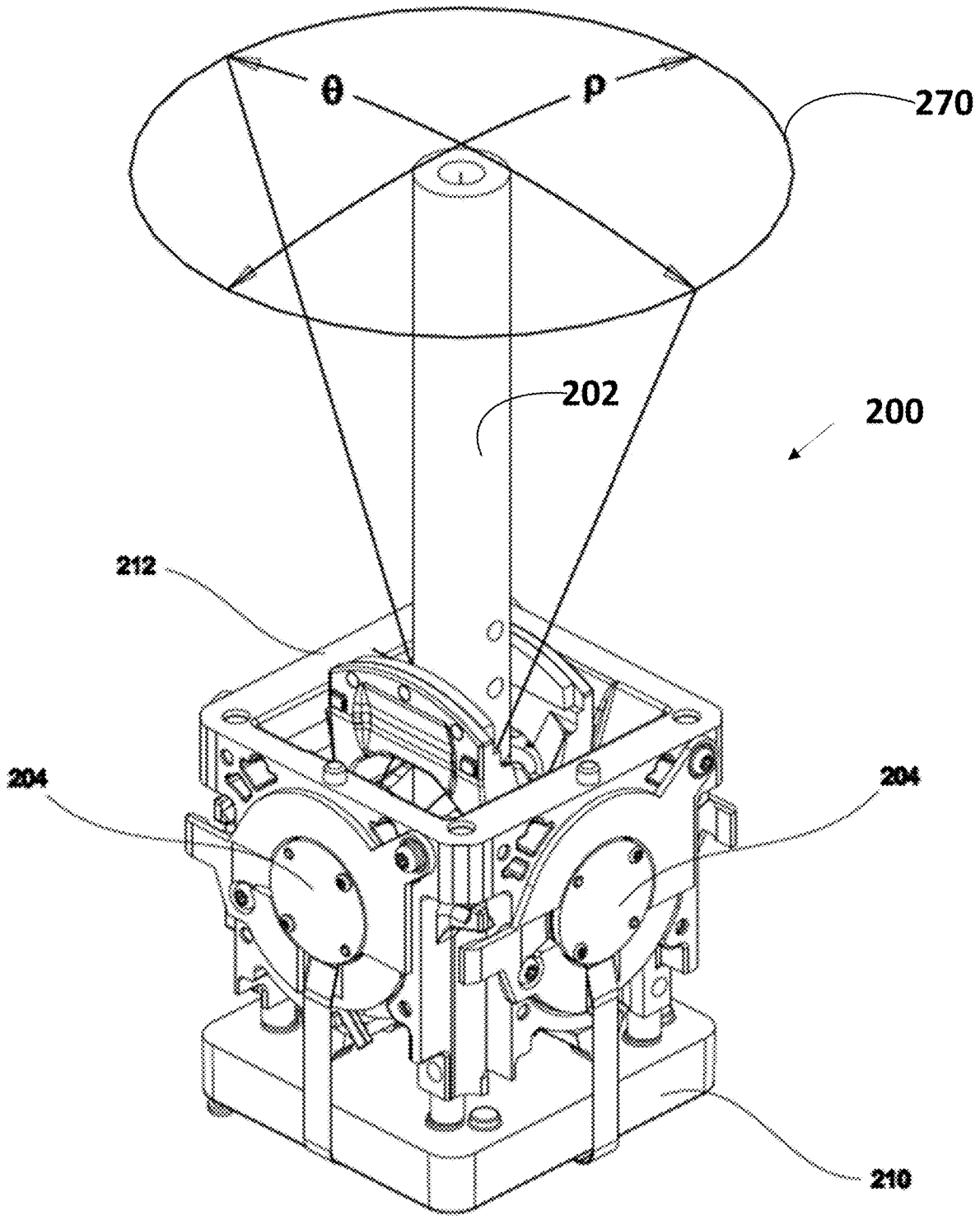
FIG. 2A is a perspective view of a joystick assembly in accordance with the subject disclosure.
Figure 2B:
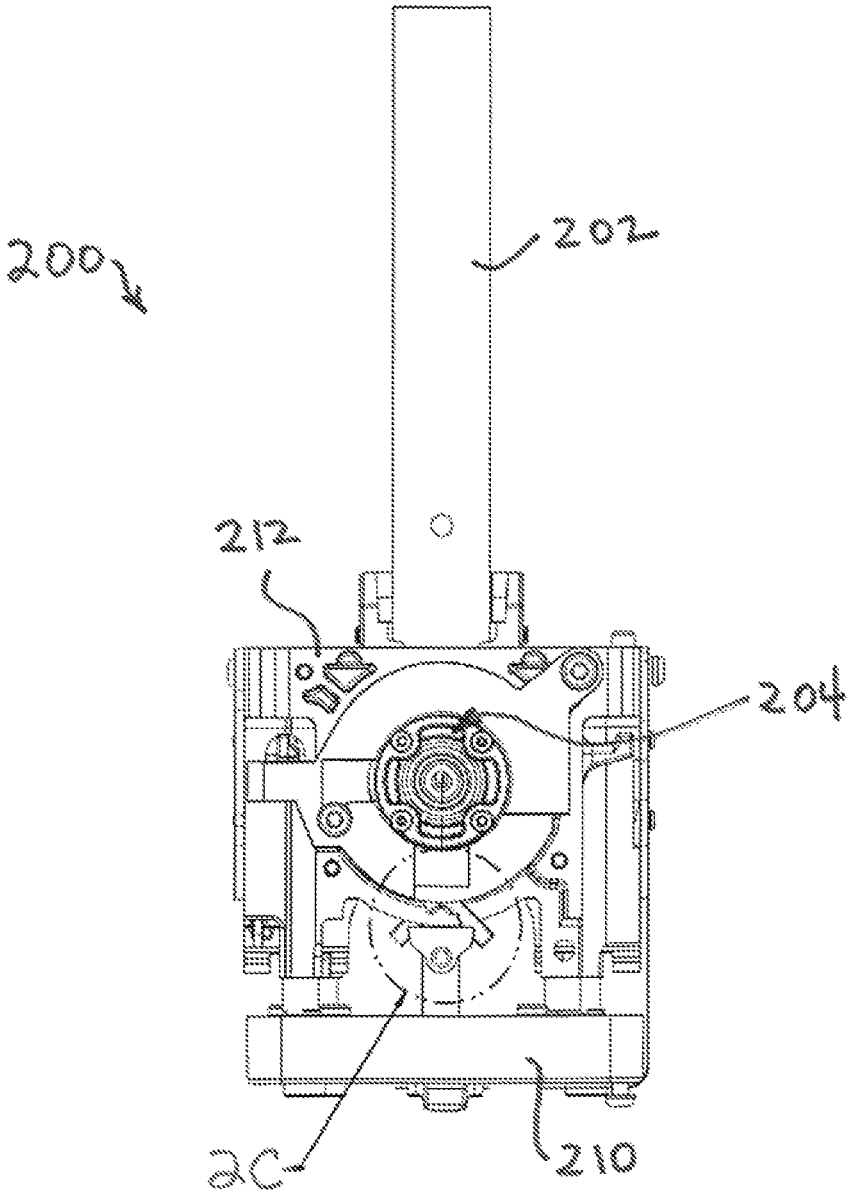
FIG. 2B is a side view of the joystick assembly of FIG. 2A.
Figure 2C:
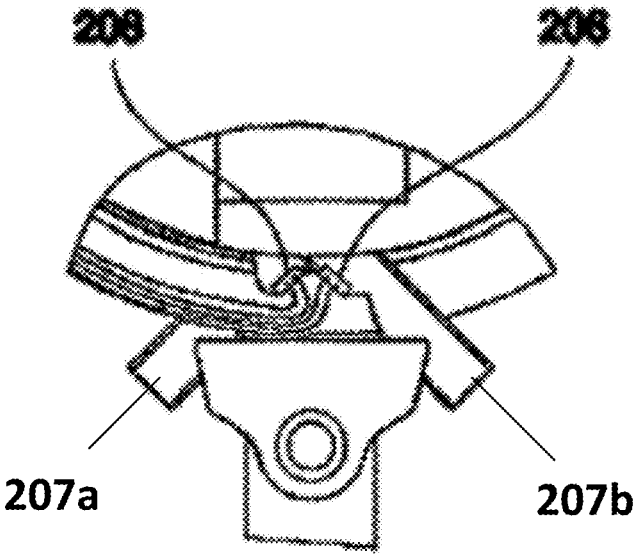
FIG. 2C is a detailed view of a portion of the joystick assembly of FIG. 2B taken inside detail circle A.

Referring to FIGS. 2A-C, various views of a joystick assembly 200 are shown. The joystick assembly 200 may be used in construction vehicles, agricultural vehicles, and other applications. The subject technology uses a dual mode sensing joystick assembly 200 to adjust and calibrate the start/stop characteristics of hydraulic flow. In addition to a first position sensor system 204, a second sensor system 206 (FIG. 2C) is used for determining the operator force on a shaft or joystick 202. The start/stop of hydraulic flow is tied directly to the force sensor system 206 while metering is controlled by the position sensor system 204. The dual mode sensing joystick assembly 200 uses force sensing on the spring stops. Preferably, the dual mode sensing joystick assembly 200 has four force sensors (e.g., strain gauges) affixed to the joystick housing 212 where the centering springs 207*a*, 207*b* are preloaded. There are two centering springs 207*a*, 207*b* used for each rotational axis of the joystick 202. The force sensors 206 can be placed under the spring legs of one of the two centering springs 207*a*, 207*b* used for each axis. Each spring leg is typically pre-loaded on the housing 212 and on top of the force sensor 206. Each spring leg is deflected when moving in one or the other direction from the centered position.

When the first spring leg is lifted from the housing 212, a first sensor beneath that leg will change to a zero value. The change to zero is used to trigger the start of the metering range. Thus, the first sensor is a position sensor component of the force sensor system 206. At the same time, the second sensor beneath the second spring leg will see an increase in force as the spring is deflected. The signal indicating the increased force is used for the metering signal. Thus, the second sensor is a metering sensor component of the position sensor system 204. The signal from the second sensor indicating the increased force can also be used for redundancy with the trigger event on the first sensor.

A third sensor on the other spring provides the position sensor component for the force sensor system 206 in the other axis. A fourth sensor on the other spring provides the metering sensor component for the position sensor system 204 in the other axis. In an alternative embodiment, the first and third sensors are simply replaced by switches to trigger the start of metering. However, such switches would not provide redundant signals for the metering value. The detents and end stops can be reliably calibrated according to traditional methods and will meet the accuracy needs of the end users adequately. In another embodiment, the sensing is performed by a single switch under the spring legs that triggers the start of metering event similar to what is described above and provides the metering signal.

In typical operation, the first position sensor system 204 is utilized for metering control. However, if the first position sensor system 204 fails, the second sensor system 206 may be used for control. In one embodiment, the dual mode sensing joystick assembly 200 is a dual-axis gimbaled joystick with pre-loaded centering springs 207*a*, 207*b* contained in the housing 212. Typically, the pre-load centering springs 207*a*, 207*b* have a relatively flat spring rate.

Figure 2D:
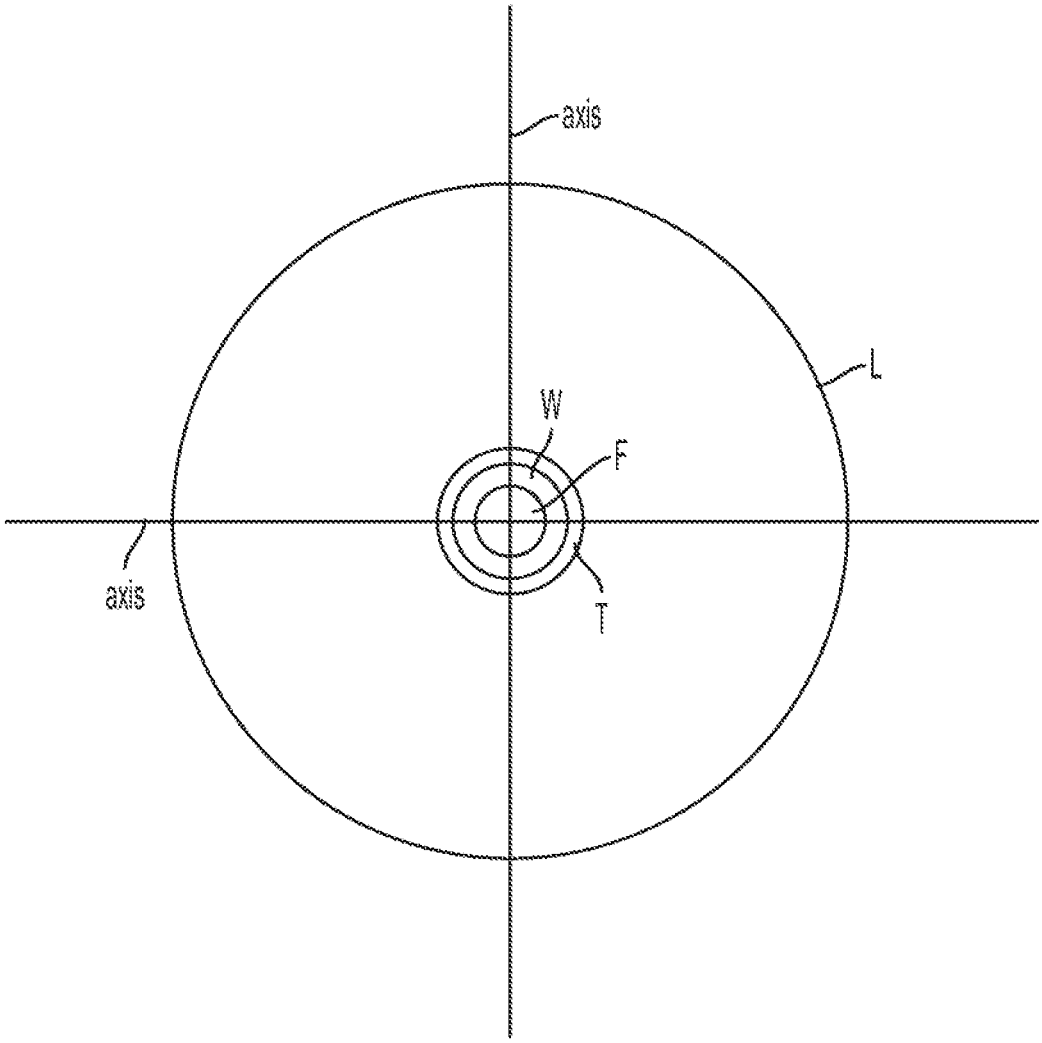
FIG. 2D is a top view of zones of travel for the joystick assembly of FIG. 2A.

Referring particularly to FIG. 2D, a top view of zones F, T, L of travel for the joystick assembly of FIG. 2A is shown. The joystick 202 is freely able to move about a circular area 270 defined in two axis by the angles θ and ρ shown in FIG. 2A. Each of the angles θ and ρ is along an axis perpendicular to the other axis. Typically, the angles θ and γ are the same but the angles θ and ρ may also be different. The zones F, T, L, W were described above with respect to FIG. 1 so the zones are not further described again.

It is envisioned that each sensor system 204, 206 may include one or more distinct sensors depending upon the particular technology. In one embodiment, the angular position sensor system 204 uses hall effect magnetic sensing. For example, the position sensor system 204 may include four magnetic sensors separated by 90°, a magnet mounted on the joystick 202, and the associated wiring and electronics. The angular position sensor system 206 generates a signal indicative of the deflection angle of the joystick shaft in each of two orthogonal rotation axis. The force sensor system 206 detects the force in each axis to determine the force applied to the joystick. It is envisioned that such force could be based upon deflection of the pre-loaded centering springs 207*a*, 207*b* but in other embodiments be directly coupled to the joystick 202.

Figure 2E:
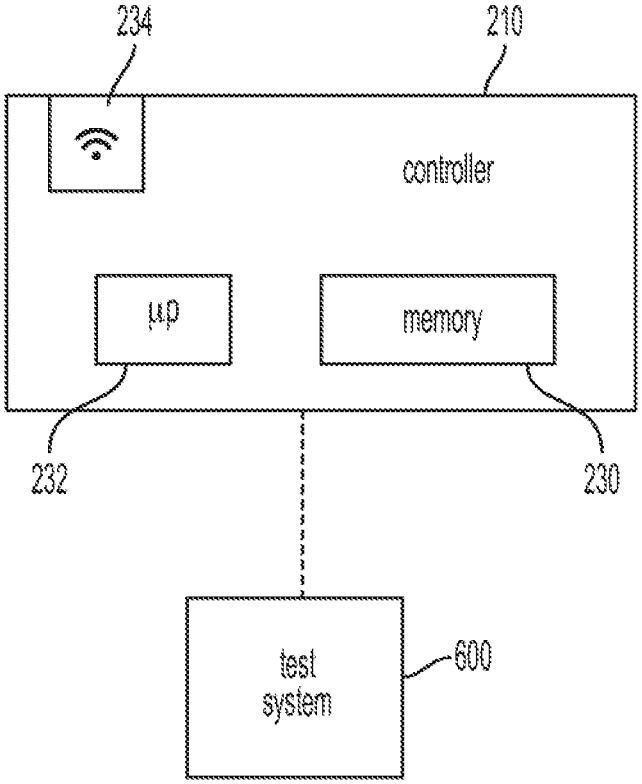
FIG. 2E is a schematic view of a controller for a joystick assembly in accordance with the subject disclosure.

Preferably, a controller 210 is in communication, wired or wireless, with the joystick assembly 200 and the sensor systems 204, 206 as shown in FIG. 2A. The controller 210 is shown schematically in FIG. 2E. The controller 210 includes memory 230 and a processor 232 operative to accomplish the functions of the joystick assembly 200 described herein. When all or part of the controller 210 is remotely located, wiring and interconnection is required as is known in the art. Alternatively, the controller may be integrated with the joystick assembly 200 such as on a printed circuit board in a housing as shown in FIG. 2A.

The controller 210 includes a wireless module 234 for communicating with the joystick assembly 200 if so configured and other components as needed. The signals from the angular position sensor system 204 and the force sensor system 206 are processed in parallel by the controller 210. The controller 210 applies algorithms to calibration data and the sensor signals to determine optimal start/stop position for hydraulic flow metering.

One exemplary algorithm relies on a controlled or synchronized sample rate between the position sensor system 204 and force sensor system 206. An algorithm that differentiates the force value with respect to the position value can be used to determine the local slope of the characteristic torque/position curve for the joystick assembly 200. Once the controller 210 has the characteristic torque/position curve, the controller 210 can deduce the specific zone that the joystick assembly 200 is actuated in. Furthermore, using the slope of the force value with respect to the position value, with the most recent adjacent data values, eliminates the need for expensive temperature calibration of the force sensor.

Preferably, the controller 210 operates the exemplary algorithm to sample each sensor storing the most recent "n" values. The controller 210 monitors the position sensor values for changes by more than a threshold value. When the position change occurs (e.g., the threshold value is exceeded), the slope from the most recent data is calculated. A table is created and stored with the slope result to determine which zone the joystick assembly 200 is in.

When the zone changes from zone "F" to "T", the position sensor value during the transition is dynamically set to be the start of the metering range. A return through the "T" zone to the "F" zone can re-set the dynamic start of metering value as well. The controller 210 may refine operation due to the effects of friction in the joystick assembly 200. For this reason, in an embodiment that uses a centering spring element, if the force sensor can be placed directly on the spring element responsible for the return torque, a simpler control algorithm may be usable because the friction will not be sensed. Conversely, having the friction data included may result in better diagnostic capabilities and better functional safety.

The controller 210 may apply a separate "plausibility" algorithm based upon stored position and force sensor value pairs established empirically during the end of line process at the manufacturing factory (i.e., factory calibration data). The plausibility algorithm may also include an expected amount of drift over typical usable life for each sensor. The value pairs found during each sample are compared to interpolated values from the stored data to detect erroneous readings.

The factory calibration data may be obtained during a procedure as follows. First, the joystick assembly 200 is externally verified to be at the spring centered position and at room temperature so that the baseline "center" sensor values can be established. Next, an operator is instructed to slowly actuate the joystick assembly 200 through the full range of travel while connected to a test system 600 (see FIG. 2A). The different zones, detents and end stops are determined by the force and position derivatives as well as maximum and minimum functions. The test system preferably notifies the operator when all of the calibration data is obtained. Then, the test system instructs the operator to move the device to each critical tactile position and verify the joystick assembly 200 output value is within specification at each such tactile position.

For systems requiring the ability to continue to operate in the event of a single element failure, a redundant position sensor or force sensor could be used. In one embodiment, the redundant sensor that agrees best with the force sensor would be selected in a reduced performance or "limp home" mode when the sensor values disagree. It is noteworthy that the force sensor could also be used for metering.

The controller 210 preferably calculates the derivative of the torque curve 302 (see FIG. 3) from the force signal of the second position sensor system 206 so that the rate of change is known. As a result, as the joystick 202 is moved to deflect the pre-loaded centering springs, the change in force upon the joystick 202 is clearly identifiable.

In operation, each sensor is used to validate the other sensor with the plausibility algorithm. For example, the force sensor system 206 can provide the same metering information as the position sensing system 204 so that if the two sets of resulting data are not within a predetermined tolerance, an error signal is generated by the controller 210. The predetermined tolerance may be less than 1%, 5%, 10% and the like. The error signal may lead to an indicator light on the dashboard being illuminated and the like. The error signal may also generate a change in control by switching over the use the force sensor system 206 instead of the position sensing system 204. The switch in control may also be selected by the operator using a dashboard switch to alternate between the sensing systems 204, 206.

Figure 3:
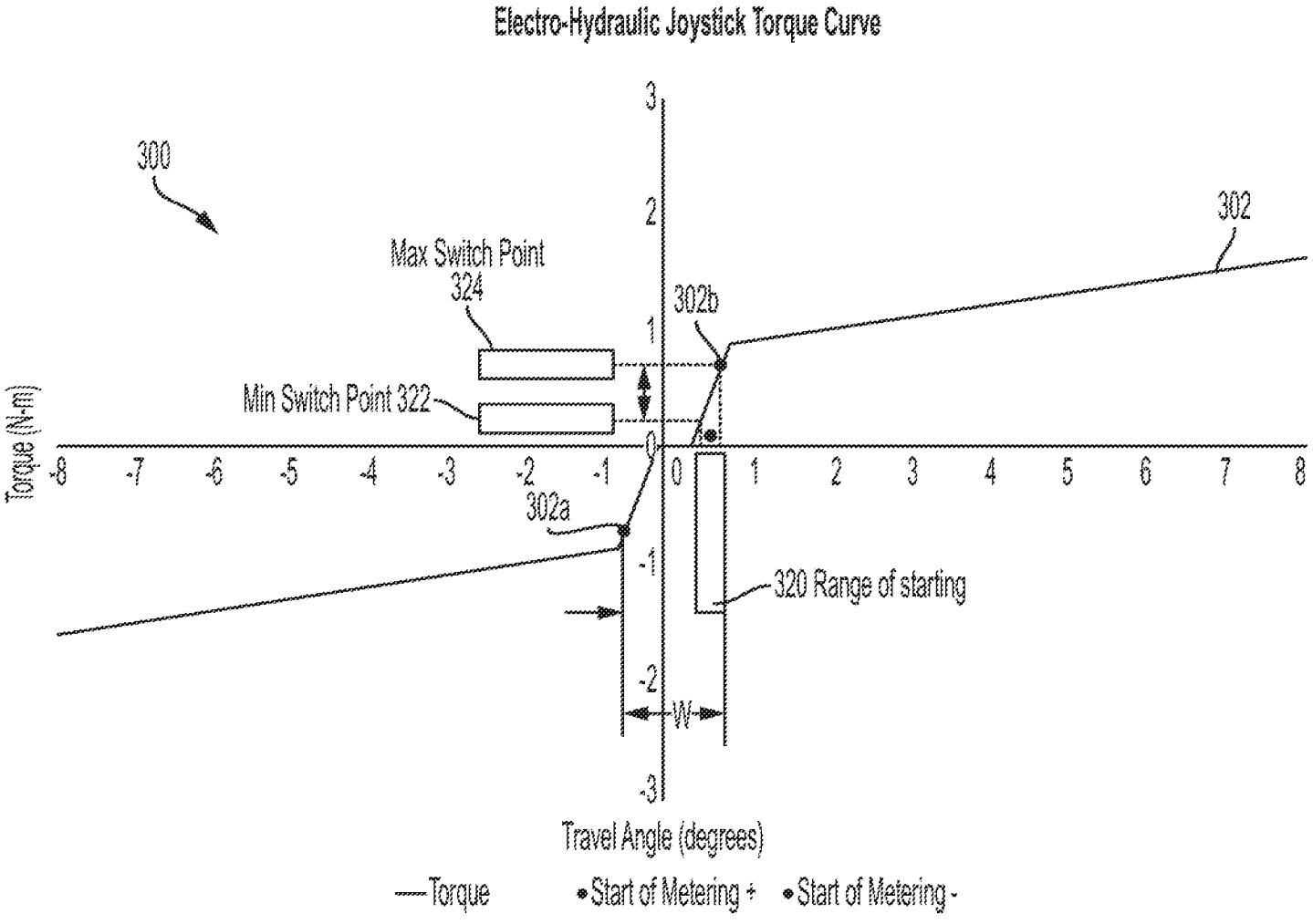
FIG. 3 is a graph of torque versus travel angle for an electro-hydraulic joystick in accordance with the subject disclosure.

Referring now to FIG. 3, a graph 300 of torque curve 302 against travel angle for an electro-hydraulic joystick in accordance with the subject disclosure is shown. As can be seen, the torque curve 302 of movement of the joystick 202 has the same shape as in FIG. 1. For clarity, the zones F, T, L are not shown. However, the points 302*a*, 302*b* to start/stop the metering are much closer to center and can be safely synchronized with the haptic feel of the joystick 202. In other words, the neutral band W is much smaller, approximately 1.5° or less instead of over 4°. In fact, there is a range 320 of starting fully within the transition zone T. As such, the points 302*a*, 302*b* could be even closer together than shown. Thus, the joystick response and feel is improved.

As noted above, the controller 210 has performed a calibration data routine to determine the torque curve 302. By evaluating the torque curve 302, the points 302*a*, 302*b* where metering begins can be optimized and synchronized with the haptic feel of the joystick 202. In one embodiment, the controller 210 uses the slope of the torque curve 302 to determine the transition zones T. As can be seen, the slope in the transition zones T differentiates from the centrally located free-play zone F (see FIG. 1) and the loaded zone L (see FIG. 1) where the relatively flat spring rate flattens out the torque curve 302. As result, the transition zones T (about +/−0.3° to about +/−0.75° are easily identified. In the transition zones T, the joystick begins to provide the desired operator feel so that hydraulic flow metering should begin.

To set the start of metering points 302*a*, 302*b*, the controller 210 can use a variety of approaches. In one embodiment, the controller 210 creates the range 320 of starting within the transition zones T that extends from a minimum possible switch point 322 to a maximum possible switch point 324. For certain safety and/or error compensation minimization, the minimum and maximum possible switch points 322, 324 may be 25% into the respective transition zone T (i.e., the starting range 320 is the central half of the transition zones T). More or less values than 25% may also be utilized. Preferably, the start/stop points 302*a*, 302*b* are set to the maximum possible switch points 324 in the defined starting range 320. By using the force sensor system 206, the start/stop of metering positions 302*a*, 302*b* can safely be held past the start of deflection of the pre-loaded centering springs. Beneficially, the drift, noise, calibration and other error is taken into account in real-time while also desirably synchronizing the haptic action of the joystick assembly 200 with the operation of the hydraulic flow metering. It is also envisioned that the joystick assembly 200 may be recalibrated at any time.

The force sensor system 206 can also used to detect an end-of-travel position in the joystick travel range for improved safety and controllability. In one embodiment, the force sensor system 206 is also used to detect detent positions in the joystick travel range a set distance short of the end-of-travel position. Preferably, the force sensor system 206 is selected to reliably differentiate between a zero force and a force less than or equal to the pre-load of the centering springs (e.g., approximately 1 N-m of torque). Such a force sensor system 206 should be configured to withstand forces of about 50 times greater than the pre-load of the centering springs.

Still further, the combination of sensor systems 204, 206 provides for improved safety and reduced production cost by simplifying and improving the initial calibration of the joystick assembly 200. After assembly, the force and position sensor systems 204, 206 are used together to auto-calibrate the joystick assembly 200. For auto-calibration, the joystick 202 is moved through the full range of motion in a controlled environment to determine the angle at which metering is expected to start as described above.

In another embodiment, one or more switches are utilized instead of the force sensor system. The switches can be set to change state (e.g., open/close) when a pre-loaded centering springs are lifted off of the respective stop. As a result, initial deflection of the pre-loaded loaded centering spring by the joystick is again determined rather than simply accounted for by an excessively wide neutral band.

Figure 4:
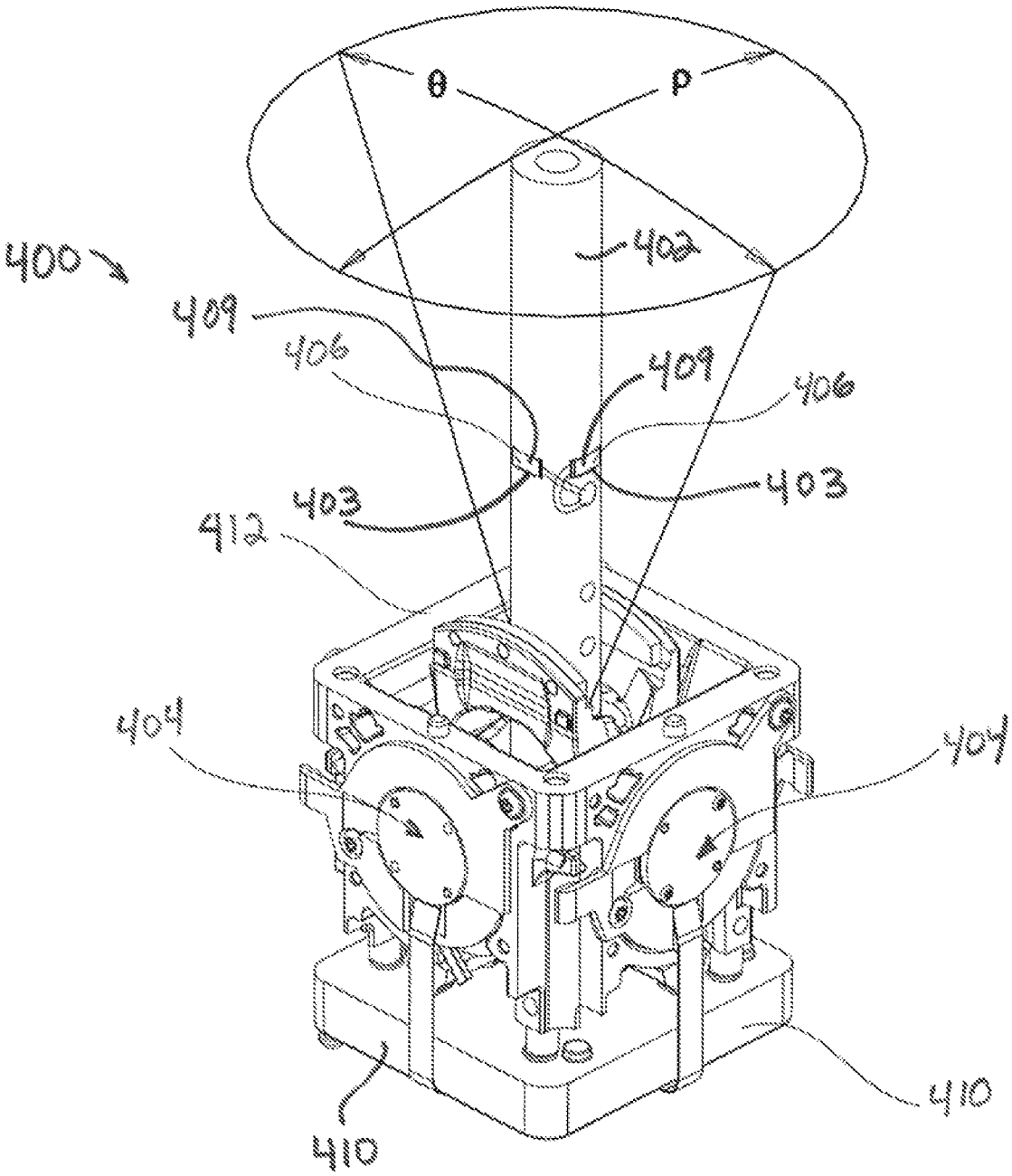
FIG. 4 is a perspective view of another joystick assembly in accordance with the subject disclosure.

In another embodiment, a joystick assembly 400 includes force sensing on the joystick 402 as shown in FIG. 4. FIG. 4 uses similar reference numerals to FIGS. 2A-C for similar components except in the 400 series instead of the 200 series. Thus, similar components are not described here in detail. The joystick assembly 400 includes two force sensors 409 (e.g., strain gauges) affixed to the joystick 402 on two perpendicular flat relief areas 403 parallel to the two primary axes of movement of the joystick 402. The sensors 409 detect bending strain in the joystick 402. Using the force sensors 409 on the joystick 402 allows for detection of detents and end stops as well as unexpected boot forces, foreign objects jamming the joystick, or overload events. In one embodiment, the joystick assembly only includes two force sensors on the joystick shaft as opposed to four sensors.

It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements (e.g., processors, sensors, interfaces, hardware and the like) described and/or shown as distinct for purposes of illustration may be incorporated within other functional elements in a particular implementation.

All patents, patent applications and other references disclosed herein are hereby expressly incorporated in their entireties by reference. While the subject technology has been described with respect to preferred embodiments, those skilled in the art will readily appreciate that various changes and/or modifications can be made to the subject technology without departing from the spirit or scope of the invention as defined by the appended claims.

What is claimed is:

1. A joystick assembly comprising:

a joystick mounted for rotational movement about a circular area;

at least one pre-load centering spring coupled to the joystick for biasing the joystick to a neutral position, wherein the joystick has a central free-play zone about the neutral position, a transitional zone surrounding the central free-play zone in which the at least one pre-load centering spring begins to act upon the joystick, and a load zone surrounding the transitional zone in which the at least one pre-load centering spring exerts a relatively flat spring rate force upon the joystick;

an angular position sensor system for generating a first signal indicative of a travel angle of the joystick;

a force sensor system for generating a second signal indicative of a force applied to the joystick; and a controller for receiving the first and second signals, wherein the controller is operative to set start/stop points for control by the joystick approximately synchronously with the joystick moving from the transitional zone to the load zone based upon the second signal.

2. The joystick assembly as recited in claim 1, wherein the start/stop points are set in the transitional zone at least 10% of the transitional zone from the load zone.

3. The joystick assembly as recited in claim 1, the controller determines fluid metering in an electro-hydraulic vehicle.

4. The joystick assembly as recited in claim 1, wherein the controller compares the first and second signals so that an error signal is generated when the first and second signals are different by more than an error threshold.

5. The joystick assembly as recited in claim 1, wherein the controller is operative to: calculate a slope of a force curve based on the second signal to determine the zones during an auto-calibration routine; and regulate the control based on the first signal between the start/stop points.

6. A joystick assembly comprising:

a joystick;

angular position sensors for generating a first signal indicative of travel angle of the joystick;

force sensors for generating a second signal indicative of a force applied to the joystick; and a controller for receiving the first and second signals, wherein the controller is operative to evaluate a torque curve for the force applied to the joystick to determine start points based on the second signal so that metering based on the first signal is optimized and synchronized with a haptic feel of the joystick.

7. The joystick assembly as recited in claim 6, wherein the controller is further operative to perform a calibration data routine to determine the torque curve.

8. The joystick assembly as recited in claim 7, wherein the controller is further operative to use a slope of the torque curve to determine a transition zone, wherein the transition zone surrounds a centrally located free-play zone, a loaded zone surrounds the transition zone, and the start point is approximately at a junction of the transition zone and the loaded zone.

9. The joystick assembly as recited in claim 8, wherein the centrally located free-play zone, the transition zone and the loaded zone are determined by analysis of a local slope of the torque curve.

10. The joystick assembly as recited in claim 8, wherein the start point is approximately 10% of the transition zone into the load zone.

11. The joystick assembly as recited in claim 6, wherein the controller is further operative to apply a plausibility algorithm based upon comparing the first and second signal to stored position and force sensor value pairs.

12. The joystick assembly as recited in claim 6, wherein the controller is further operative to calculate a derivative of the torque curve.

13. The joystick assembly as recited in claim 6, further comprising a switch in communication with the controller so that metering control based upon the first signal can be selected.

14. The joystick assembly as recited in claim 6, wherein the controller is further operative to calculate an end-of-travel position based upon the first signal during a calibration routine.

15. A dual mode sensing joystick assembly for an electro-hydraulic vehicle comprising:

a joystick;

pre-loaded centering springs coupled to the joystick for biasing the joystick to a neutral position;

angular position sensors for generating a first signal indicative of travel angle of the joystick;

force sensors for generating a second signal indicative of a force applied to the joystick; and a controller for receiving the first and second signals, wherein the controller is operative to determine initial deflection of the pre-loaded centering springs based upon the second signal so that fluid metering in the electro-hydraulic vehicle is started by the first signal indicating the initial deflection has occurred to trigger the fluid metering being governed by the first signal.

* * * * *